US008471475B1

(12) United States Patent
Xiong

(10) Patent No.: US 8,471,475 B1
(45) Date of Patent: Jun. 25, 2013

(54) MODULAR DIMMING BALLAST WITH DECOUPLED HALF-BRIDGE TOPOLOGY

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 446 days.

(21) Appl. No.: 12/888,475

(22) Filed: Sep. 23, 2010

Related U.S. Application Data

(60) Provisional application No. 61/367,008, filed on Jul. 23, 2010.

(51) Int. Cl.
*H01J 7/44* (2006.01)

(52) U.S. Cl.
USPC ..... 315/64; 315/65

(58) Field of Classification Search
USPC ..... 315/291, 307, 64, 65, 66, 69, 70, 315/209 R, 213, 277, 312, 317
See application file for complete search history.

(56) References Cited

U.S. PATENT DOCUMENTS

| | | | | |
|---|---|---|---|---|
| 6,611,112 | B2 * | 8/2003 | Raiser et al. | 315/291 |
| 6,696,791 | B2 * | 2/2004 | Raiser et al. | 315/94 |
| 7,045,970 | B2 * | 5/2006 | Lecheler et al. | 315/274 |
| 7,193,373 | B2 * | 3/2007 | Storm | 315/291 |
| 7,196,479 | B2 * | 3/2007 | Storm | 315/209 R |
| 7,479,774 | B2 * | 1/2009 | Wai et al. | 323/284 |

* cited by examiner

*Primary Examiner* — Minh D A
(74) *Attorney, Agent, or Firm* — Waddey & Patterson, P.C.; Mark J. Patterson; Gary L. Montle

(57) ABSTRACT

An electronic ballast is provided and a method for operating one or more lamps. The ballast and method provide for true parallel lamp operation, with preheating of lamp filaments during a dimming operation. Switching losses are reduced by ensured soft switching operation. An inverter switch driver is arranged to provide first drive signals to a shared line branch having a first switch shared among a plurality of decoupled inverter drive modules and to provide second drive signals to a plurality of independent line branches each having a switch and associated with one of the decoupled inverter drive modules. A soft switching control circuit is coupled to the first switch and configured so as to maintain a soft switching operation for the first switch.

20 Claims, 6 Drawing Sheets

MODULAR DIMMING BALLAST WITH DECOUPLED HALF-BRIDGE TOPOLOGY

CROSS-REFERENCES TO RELATED APPLICATIONS

This application claims benefit of the following patent application(s) which is/are hereby incorporated by reference: U.S. Provisional Application No. 61/367,008, filed on Jul. 23, 2010.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to electronic ballasts for powering discharge lamps. More particularly, the present invention relates to electronic ballasts and associated methods for operating discharge lamps connected in parallel and capable of providing filament heating during a lamp dimming operation.

Electronic ballasts with dimming capability are becoming increasingly popular, due at least in part to their light output control and corresponding energy savings. However, most dimming ballasts are incapable of operating lamps independently. The majority of lamp configurations used with existing dimming ballasts tend to be in series, meaning that if any one lamp is removed all of the accompanying lamps will necessarily be shut down, and further when any individual lamp reaches an end-of-life condition the ballast itself is going to be shut down. These operations result in large expense and inconvenience.

Traditional so-called parallel lamp ballasts provide drawbacks of their own, in that whenever a lamp is removed the lamp current through the remaining lamps in the circuit will change dramatically. A true parallel lamp configuration should maintain the same lamp current regardless of the number of lamps connected to the ballast at a given time.

Lamp ballasts as previously known in the art have sought to provide true parallel operation by providing a decoupled half-bridge inverter configuration, with one line branch (and associated switching element) shared among each discharge lamp and various additional line branches having dedicated switching elements and independently assigned to a particular discharge lamp. These configurations allow for each lamp to be disabled independently, and further operate at the same lamp current output regardless of the failure or removal of one or more lamps.

However, these configurations as previously known have large switching losses due to hard switching of the shared switching element, which renders such applications substantially unusable.

BRIEF SUMMARY OF THE INVENTION

An electronic ballast and a method for operating one or more discharge lamps are provided in various embodiments as described herein. The ballast and method of the present invention may provide for true parallel lamp operation, as well as preheating of lamp filaments during a dimming operation. The electronic discharge lamp ballast may further maintain a constant lamp current regardless of the number of lamps connected to the ballast at a given time.

In one aspect of the present disclosure, switching losses for the electronic ballast may be dramatically reduced by soft switching operation of a shared switching element among a plurality of decoupled half-bridge inverter modules. A soft switching control block may be provided that, in one example further described in greater detail below, establishes a zero voltage prior to the switch turning on by facilitating conduction of negative current via a body diode of the switch before the switch conducts positive current.

In an embodiment of an electronic discharge ballast of the present disclosure, an inverter switch driver is arranged to provide first drive signals to a shared line branch having a first switch shared among a plurality of decoupled inverter drive modules, and further arranged to provide second drive signals to a plurality of independent line branches each having a switch and associated with one of the decoupled inverter drive modules. A soft switching control circuit is coupled to the first switch and configured so as to maintain a soft switching operation for the first switch.

In another embodiment, an electronic ballast in accordance with the present invention includes an inverter switch driver having a high side switch output terminal and low side switch output terminal. An array of decoupled inverter drive modules share a common first switch arranged to receive driver signals from one of the high side or low side switch output terminals. Each decoupled inverter drive module further includes a separate second switch arranged to receive driver signals from the other of the high side or low side switch output terminals. The first switch and the plurality of switches associated with the independent line branches further define a plurality of half-bridge inverter branches effective to generate a lamp drive output voltage. A soft switching control circuit is coupled to the first switch and configured so as to maintain a soft switching operation for the first switch.

In another embodiment, a method for operating an electronic ballast of the present invention includes providing first drive signals to a shared line branch having a first switch shared among a plurality of decoupled inverter drive modules connected in parallel. The method further includes the step of providing second drive signals to a plurality of independent line branches each having a switch and associated with one of the plurality of decoupled inverter drive modules, wherein the first switch and the plurality of switches associated with the independent line branches further define a plurality of half-bridge inverter branches effective to generate a lamp drive output voltage. The method even further includes the step of generating a lag current in soft switching control circuitry coupled to the first switch, wherein the lag current turns on a body diode of the first switch prior to conduction of positive current by the first switch so as to maintain a soft switching operation for the first switch.

DETAILED DESCRIPTION OF THE INVENTION

Figure 1:
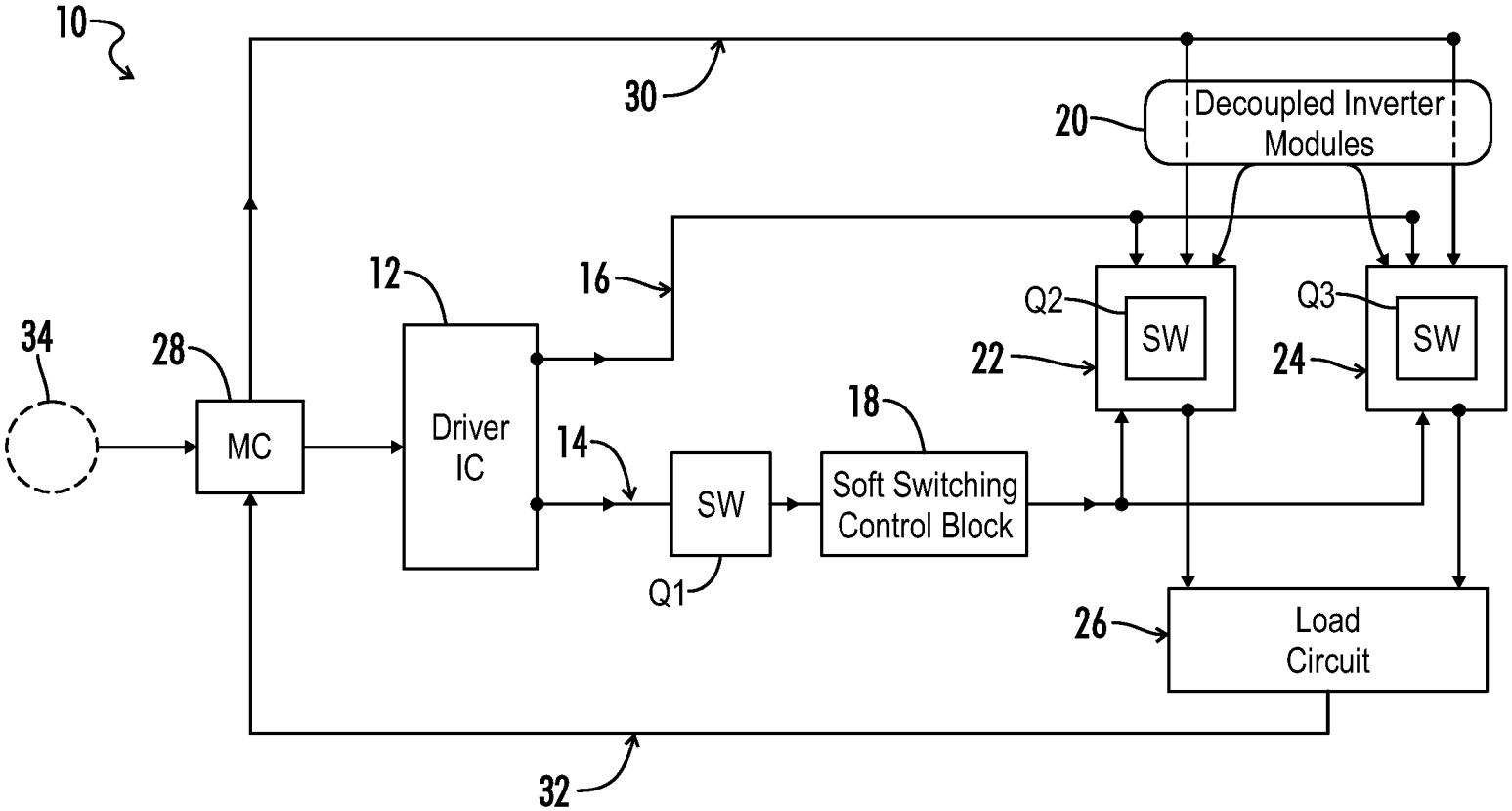
FIG. 1 is a block diagram showing various modules of an electronic ballast according to an embodiment of the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller" and/or "control circuit" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

Referring generally to FIGS. 1 through 6, various embodiments are described herein for an electronic ballast having multiple decoupled half-bridge inverter modules for driving one or more discharge lamps in a true parallel configuration. Various embodiments are further described herein for methods of operating the electronic ballast wherein filament heating, continuous dimming, and independent lamp operation are provided regardless of the number of lamps connected to the ballast. Where the various figures may describe embodiments sharing various common elements and features with other embodiments, similar elements and features are given the same reference numerals and redundant description thereof may be omitted below.

Referring first to an embodiment of the present invention as shown in FIG. 1, an electronic ballast 10 includes an inverter driver 12, a plurality of decoupled inverter modules 20 connected in parallel and each having a dedicated switch (Q2, Q3 . . . Qx), and a switch Q1 shared among each of the inverter modules 20. The shared switch Q1 in combination with any one of the dedicated switches (e.g., Q2 in a first inverter module 20, 22) may define a half-bridge switching circuit and generate an output voltage for the inverter module 20, 22 responsive to first driver signals 14 and second driver signals 16 from the inverter driver 12. The output voltage generated by the inverter module 20, 22 is provided to a load circuit 26 which includes output terminals to which a discharge lamp may be connected.

In the embodiment shown, the first inverter module 22 and a second inverter module 24 may be a filament heating inverter module and a lamp driver inverter module, respectively, wherein both of the output voltage from the filament heating inverter module 22 and the lamp driver inverter module 24 are provided to the same load circuit 26 to provide a filament heating voltage and a lamp driving voltage, respectively.

In various embodiments additional inverter modules 20 may be coupled in parallel with the modules 22, 24 shown, wherein the lamp driver inverter module may define a first lamp driver inverter module 24*a* and the additional modules may define lamp driver inverter modules 24*b*, 24*c* . . . 24*x*, with each lamp driver inverter module 24*a*, 24*b* . . . 24*x* being associated with and further providing a lamp driving output voltage to an independent load circuit 26*a*, 26*b* . . . 26*x*. The filament heating inverter module 22 may be arranged, however, to provide an equivalent filament heating voltage to each of the load circuits 26*a*, 26*b* . . . 26*x* as desired.

It may be understood within the scope of the present invention that in alternative embodiments of an electronic ballast (not shown) each of the decoupled inverter modules 20 may be lamp driver modules associated with a particular load circuit, wherein a filament heating voltage in such embodiments is either provided from a separate source or not at all.

The ballast 10 of the present disclosure further includes a soft switching control block 18 which is coupled to the first switch Q1 and is arranged to ensure soft switching operation of the first switch Q1 each time it is turned on, as may be further described below.

A controller 28 provides control signals 30 to the decoupled inverter modules 20 which are capable of enabling or disabling the switching elements in particular inverter modules. The controller may determine that a particular switch is to be enabled or disabled based on, for example, one or more of an operating mode for a load circuit 26 coupled to receive an output voltage from the inverter module, sensor feedback signals 32 received by the controller 28 from the load circuit 26, and external control signals (such as for example dimming control signals) received by the controller 28 from an external device 34.

In an embodiment as shown in FIG. 1, the control functions associated with the controller 28 and the inverter driver 12 are separately embodied, but it may be understood by one of skill in the art that a single microcontroller or integrated circuit may be adapted to embody the control functions associated with both of the controller 28 and the inverter driver 12.

Figure 2:
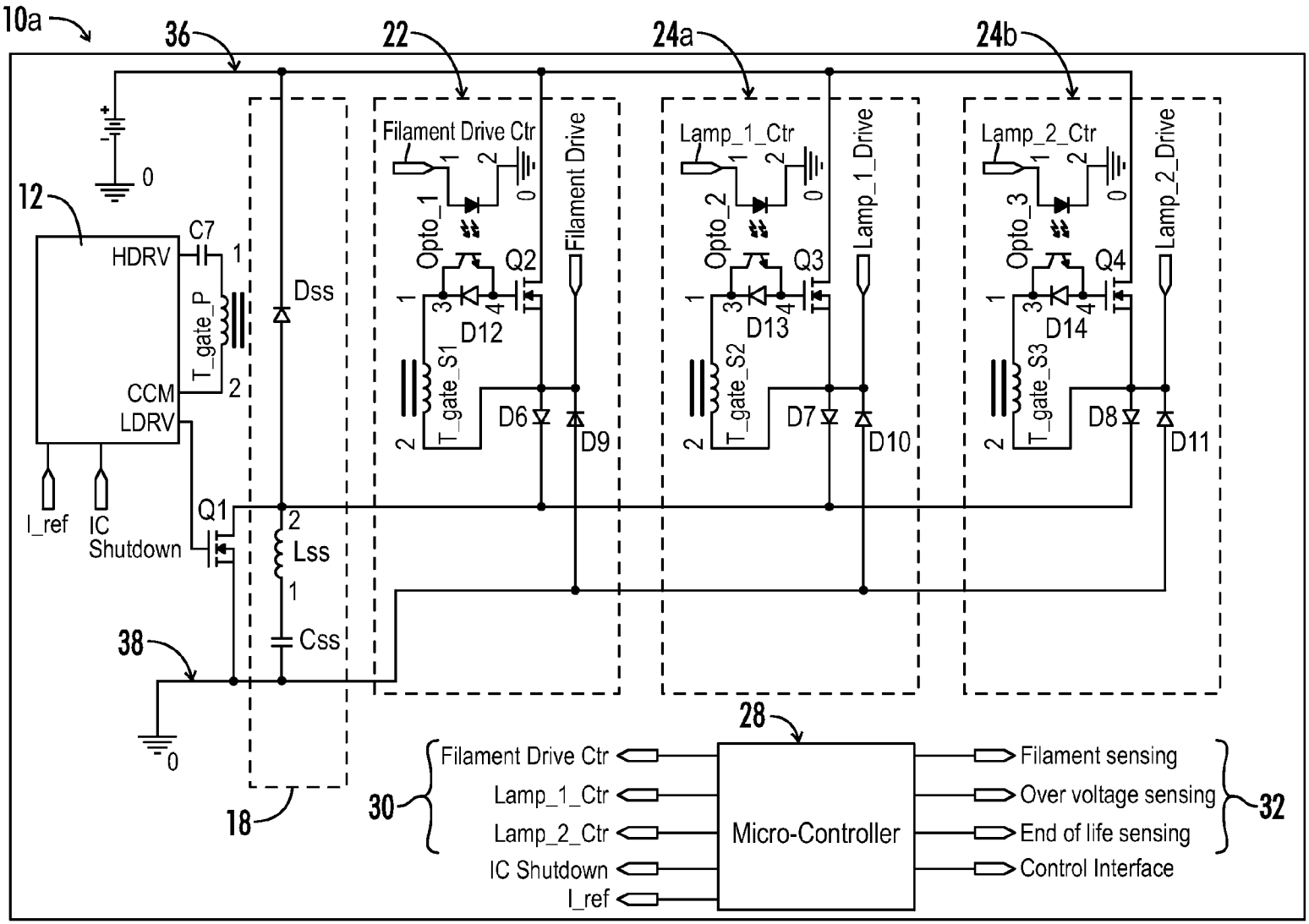
FIG. 2 is a circuit diagram showing an example of the electronic ballast according to FIG. 1.

Referring now to FIG. 2, a particular embodiment of the electronic ballast 10*a* of the present invention may be described in greater detail. An inverter driver 12 which in various embodiments generally may be embodied in an integrated circuit (IC) provides low side and high side gate drive signals. The driver 12 may provide gate drive signals of various operating frequencies depending on the desired operation, wherein for example a gate drive signal of a first frequency may be provided for a filament preheating operation, a gate drive signal of a second frequency may be provided for a lamp ignition operation, and a gate drive signal of a third frequency may be provided for a steady-state operation. The driver 12 may be configured to change the frequency of the gate drive signals in accordance with control signals and/or feedback signals provided from the controller 28, such as for example a reference current I_ref wherein the lamp current can be adjusted according to the I_ref signal.

A gate drive transformer T_gate_P may be coupled to the high side gate drive terminal HDRV of the driver 12 and is driven by the high side gate drive signals provided by the driver 12. A capacitor C7 is used to block the DC signal from terminal HDRV. Secondary windings T_gate_s1, T_gate_s2 and T_gate_s3 of the gate drive transformer T_gate_P are used to drive high side switches Q2, Q3, Q4 in three decoupled inverter modules 20. In the embodiment shown, the decoupled inverter modules 20 are made up of a filament drive module 22, a first lamp drive module 24*a* and a second lamp drive module 24*b*. These three modules 22, 24*a*, 24*b* have the same switch configuration except that the outputs from the half-bridge are different. Diodes D6 and D9, D7 and D10, D8 and D11 are used to decouple the bridge connections between the three inverter modules 22, 24*a*, 24*b*, respectively.

A low side MOSFET switch (Q1) is coupled to the low side gate drive terminal LDRV of the driver 12 and is driven directly by the low side gate drive signals from the driver 12. The low side switch Q1 in this example is shared by all of the decoupled inverter drive modules 20. In alternative embodiments however, the shared switch Q1 may be coupled to the high side gate drive port within the scope of the present invention, as for example will be described further below with respect to FIG. 3.

Switch Q1, diodes D6 and D9, and switch Q2 collectively form a first half-bridge with components Q1, D6, D9 defining a low side switching circuit, switch Q2 defining a high side switching circuit, and an output terminal (Filament Drive) for the half-bridge coupled between the low side and high side switching circuits.

Switch Q1, diodes D7 and D10, and switch Q3 collectively form a second half-bridge with components Q1, D7, D10 defining a low side switching circuit, switch Q3 defining a high side switching circuit, and an output terminal (Lamp_1_Drive) for the half-bridge coupled between the low side and high side switching circuits.

Switch Q1, diodes D8 and D11, and switch Q4 collectively form a third half-bridge with components Q1, D8, D11 defining a low side switching circuit, switch Q4 defining a high side switching circuit, and an output terminal (Lamp_2_Drive) for the half-bridge coupled between the low side and high side switching circuits.

Opto-coupler devices (Opto_1, Opto_2, Opto_3) are included in the inverter modules 22, 24*a*, 24*b*, respectively, and are controlled by module control signals 30 from the controller 28 (individually represented in FIG. 2 as Filament drive_ctl, lamp1_ctl and lamp2_ctl, respectively) to enable or disable the high gate drive signals to the switches Q2, Q3, Q4, respectively. Switches Q2, Q3, Q4 are driven collectively by signals provided via the gate drive transformer T_gate.

Using inverter module 22 as an example, when control signals 30 from the controller 28 are low, the opto-coupler Opto_1 will be turned off such that the gate of switch Q2 will be charged up to a negative voltage through diode D12 and therefore turning off the switch Q2 and reliably disabling the half-bridge. An equivalent operation may be carried out with respect to low control signals 30 to the other inverter modules 24*a*, 24*b*. If opto-coupler Opto_2 is turned off by a control signal from the controller, the switch Q3 will be forced off and the half-bridge formed by switches Q1, Q3 is disabled. If opto-coupler Opto_3 is turned off by a control signal from the controller, the switch Q4 will be forced off and the half-bridge formed by switches Q1, Q4 is disabled.

A soft switching control block 18 is coupled to the shared switch Q1 to facilitate soft switching operation. An inductor Lss and capacitor Css are coupled in series across the drain and source of the switch Q1, with the source and the capacitor Css coupled to earth, and a diode Dss is coupled between the inductor Lss and a positive DC rail 36 further coupled to a DC source (VDC). The inductor Lss and capacitor Css form an inductive branch whose current lags the input voltage. This lag current turns on a body diode of the shared switch Q1 first before it conducts the positive current. As a result soft-switching is realized for the shared switch Q1, and switching losses may be dramatically reduced.

Figure 3:
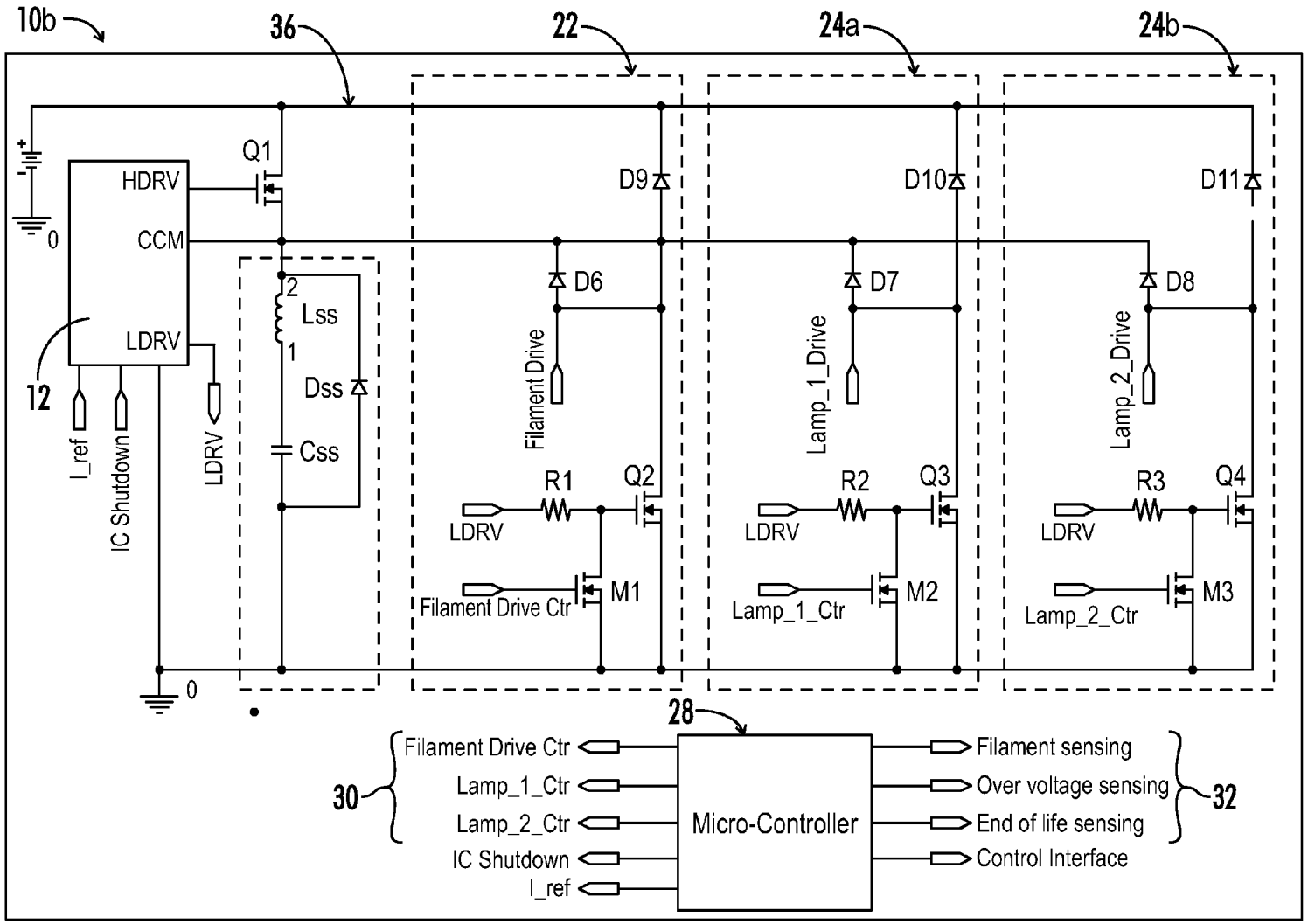
FIG. 3 is a circuit diagram showing another example of the electronic ballast according to FIG. 1.

Referring now to FIG. 3, an embodiment of the ballast 10*b* may include an alternative configuration for the components previously described. The shared switch Q1 is now coupled to the high side gate drive terminal HDRV and driven directly by high side gate drive signals from the driver 12. Switches Q2, Q3, Q4 are now low side switches. Diodes D6, D9 decouple Q2 from switches Q3, Q4, diodes D7, D10 decouple Q3 from switches Q2, Q4 and diodes D8, D11 decouple Q4 from switches Q2, Q3. Resistors R1, R2, r3 are gate drive resistors for switches Q2, Q3, Q4, respectively.

Switches M1, M2, M3 are low signal switches that are controlled by control signals Filament_drive_ctl, lamp_1_ctl, and lamp_2_ctl, respectively. If switch M1 is turned on by a control signal, switch Q2 is forced off such that the half-bridge formed by switches Q1, Q2 is disabled. If switch M2 is turned on by a control signal, switch Q3 is forced off such that the half-bridge formed by switches Q1, Q3 is disabled. If switch M3 is turned on by a control signal, switch Q4 is forced off such that the half-bridge formed by switches Q1, Q4 is disabled.

In the soft switching control block 18 of FIG. 3, the source of shared switch Q1 is coupled to the DC rail 36, with a first end of the inductor Lss coupled to the drain of the shared switch Q1 and a second end of the inductor Lss coupled to the capacitor Css, the inductor Lss and the capacitor Css being coupled in series between the source of the shared switch Q1 and an earth terminal. The diode Dss is coupled in parallel with the series circuit of the inductor Lss and the capacitor Css.

In other respects, the configuration and operation of embodiments of the ballast 10*b* as shown in FIG. 3 may be substantially equivalent to those of FIG. 2, and further description is omitted as unnecessary.

Figure 4:
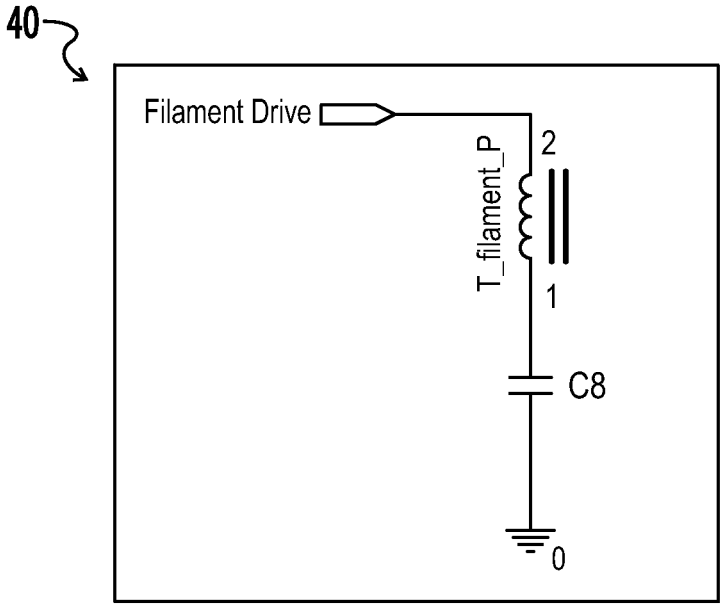
FIG. 4 is a circuit diagram showing an example of a filament drive circuit in an embodiment of the electronic ballast of the present invention.

FIG. 4 shows an example implementation of a filament drive tank 40 in various embodiments of a ballast 10 of the present invention. The filament drive tank 40 as shown may be used for example with either of the ballast configurations 10*a*, 10*b* as shown in FIGS. 2 and 3. T_filament_P is the primary winding of a filament drive transformer. Capacitor C8 is a DC-blocking capacitor. The input to the filament drive tank 40 is provided from the output terminal (Filament Drive) of the filament drive module 22.

Figure 5:
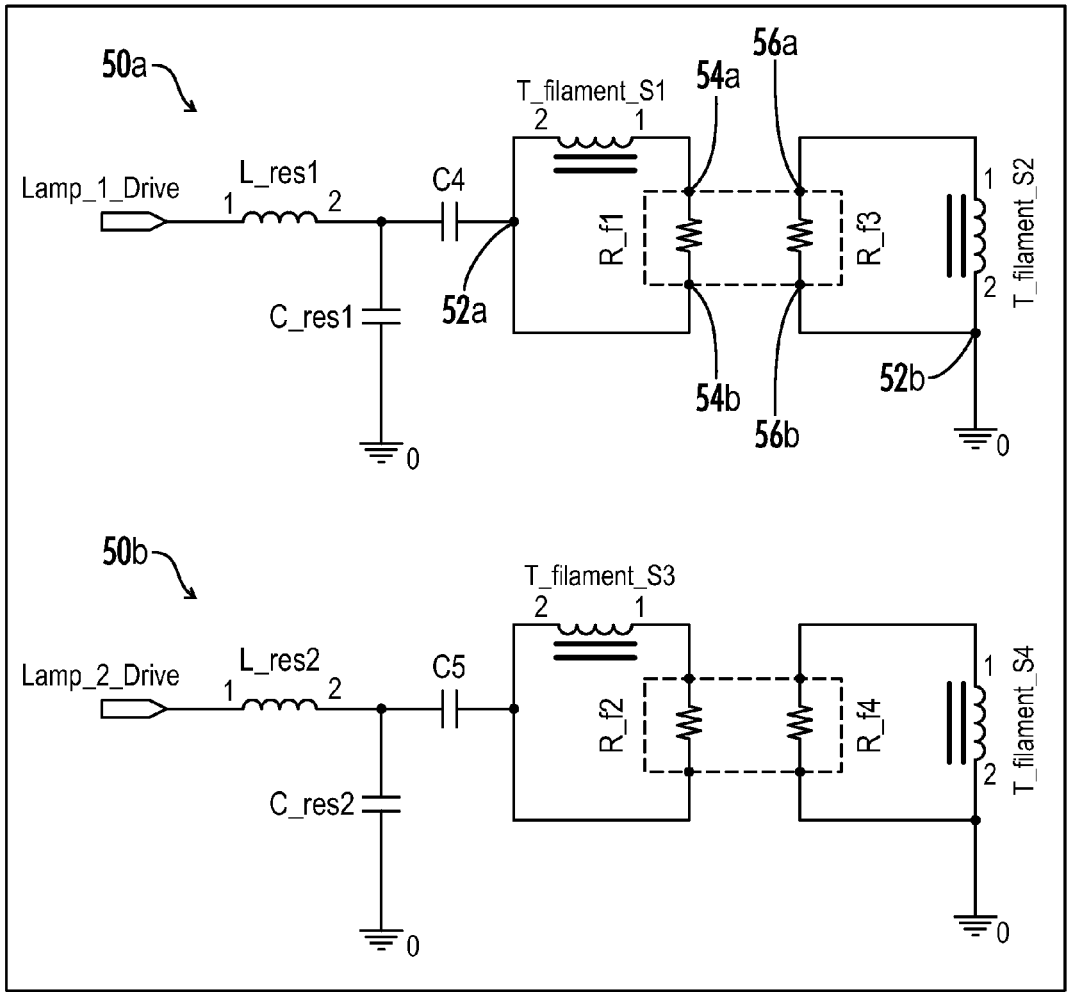
FIG. 5 is a circuit diagram showing an example of a load circuit according to an embodiment of the electronic ballast of the present invention.

FIG. 5 shows an example of a pair of load circuits 50*a*, 50*b*. Inputs lamp1_drive and lamp2_drive come from the output terminals of the inverter modules 24*a*, 24*b*, respectively. Inductor L_res1 and capacitor C_res1 form a first series resonant circuit in load circuit 50*a*. Inductor L_res2 and capacitor C_res2 form a second series resonant circuit in load circuit 50*b*. An output voltage generated by the resonant circuit for a given load circuit (for example 50*a*) is applied across terminals 52*a*, 52*b* and may be provided to a lamp coupled to the load circuit 50*a*. Capacitors C4 and C5 are used to block DC current through lamps which may be connected to output terminals in the load circuits.

R_fl1 and R_fl3 are filaments for a lamp coupled to the first load circuit 50*a*, and R_fl2 and R_fl4 are filaments for a lamp coupled to the second load circuit 50*b*. The lamp filaments are driven by the secondary windings T_filament_s1, s2, s3, s4 for the filament transformer. T_filament_s1 generates a filament heating voltage across output terminals 54*a*, 54*b* of the first load circuit 50*a* and thereby drives filament R_fl1. T_filament_s2 generates a filament heating voltage across output terminals 56*a*, 56*b* of the first load circuit 50*a* and thereby drives filament R_fl3. T_filament_s3 generates a filament heating voltage across output terminals 54*a*, 54*b* of the second load circuit 50*b* and thereby drives filament R_fl2. T_filament_s4 generates a filament heating voltage across output terminals 56*a*, 56*b* of the second load circuit 50*b* and thereby drives filament R_fl4.

Figure 6:
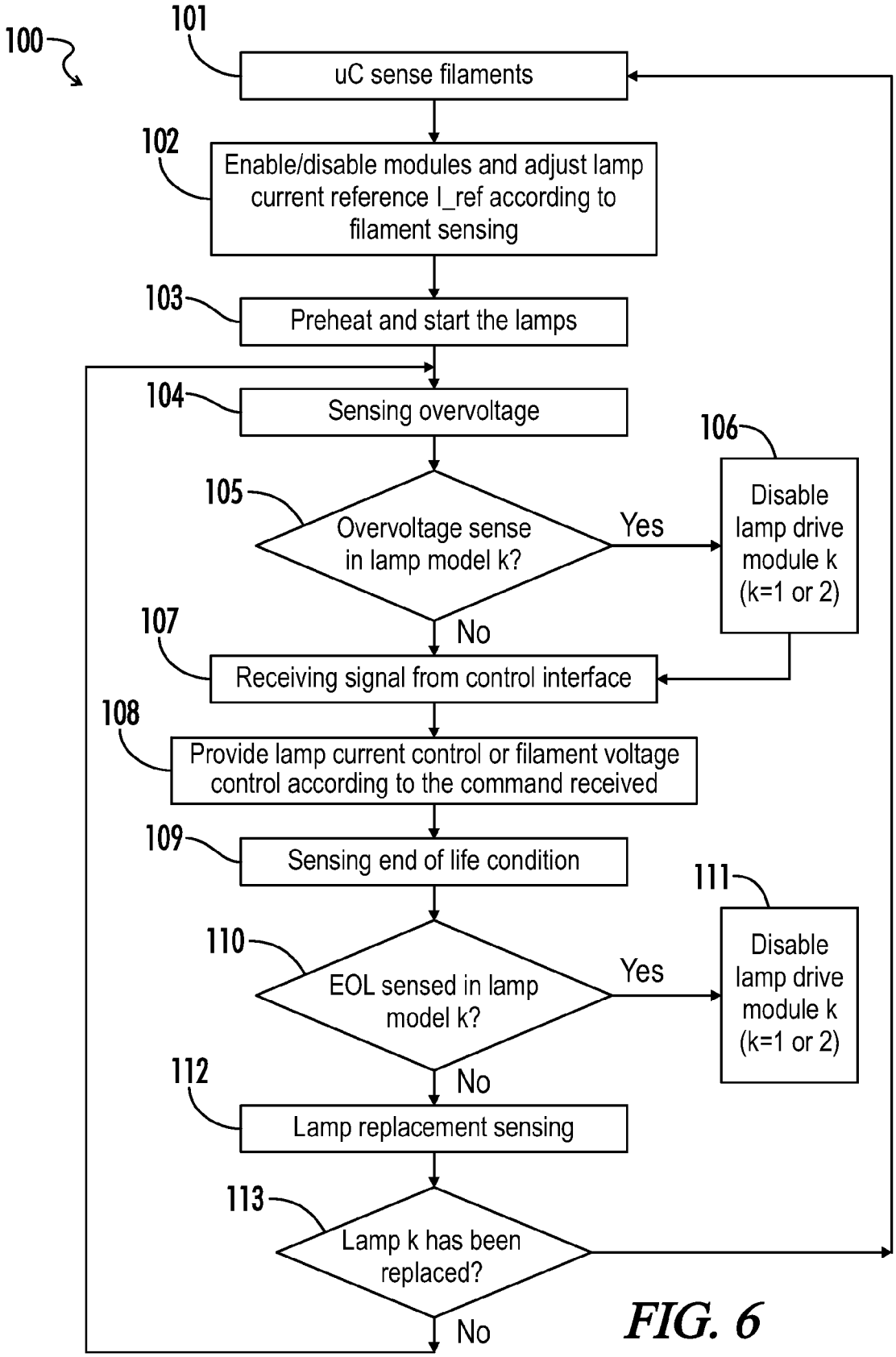
FIG. 6 is a flowchart showing an example of a control method for the electronic ballast of the present invention.

Referring now to the flowchart of FIG. 6, an exemplary method of operation 100 for the electronic ballast of the present invention may now be described.

In step 101, the controller receives a sensor feedback signal from sensors in one or more load circuits associated with the ballast that sense lamp filaments coupled to the load circuits. The actual sensors are not shown or otherwise described herein, as they may be of a type and use that are well known to those of skill in the art. Based on the sensed filaments, the controller enables or disables individual decoupled inverter modules and further adjusts the lamp current reference I_ref (step 102). The controller may generally disable any inverter modules that are associated with load circuits for which lamp filaments are not detected, and likewise enable any inverter modules that are associated with load circuits for which lamp filaments are detected. If the controller senses no lamp filaments connected to any of the load circuits it may disable the driver and thereby the ballast entirely.

In step 103, the controller then preheats and starts the detected lamps. In various embodiments, this step may actually include one or more sub-steps associated with, for example, a first operating mode wherein the lamp filaments are preheated, a second operating mode wherein the lamps are ignited, and a third operating mode wherein the lamps are driven in steady-state and in accordance with the lamp current reference I_ref.

In a preheat operating mode, the controller may for example disable the lamp drive modules and enable the filament heating module, whereby only a filament heating voltage is generated in response to high side and low side (e.g., first and second) gate drive signals provided from the driver and having a frequency associated with the preheat operating mode.

After a period of time has passed, the controller may enter the lamp ignition operating mode, disabling the filament heating module and enabling lamp drive modules which are associated with load circuits having detected lamp filaments. Lamp driving voltages are generated in response to high side and low side (e.g. first and second) gate drive signals provided from the driver and having a frequency associated with the lamp ignition operating mode.

After the lamps that are connected to the ballast have started, the controller may enter a steady-state operating mode in which the frequencies of the high side and low side (e.g., first and second) gate drive signals provided from the driver are appropriately adjusted.

In step 104, the controller may receive overvoltage sensor signals from any one or more lamp drive modules or load circuits, depending on the location of the overvoltage sensors. Such sensors are well known in the art and further description of their configuration or location may be omitted herein, as various types of sensors and signals may be used within the scope of the present disclosure.

The controller may determine in step 105 whether an overvoltage condition is present in lamp module k, where (k=1, 2 . . . x, depending on the number of load circuits). If an overvoltage condition is sensed, the controller proceeds to step 106 and disables the lamp drive module (k) associated with the overvoltage condition by for example pulling low (i.e., setting to zero) the appropriate module control signal as described above.

After any lamp drive modules have been disabled in step 106 due to an overvoltage condition, or alternatively where no overvoltage condition has been detected in step 105, the controller may continue to step 107 wherein signals may be received by the controller from an external device via a control interface. The signals may communicate, for example, a dimming control set point, and may be provided in various protocols as are known in the art, such as for example 0-10V analog, DALI, Address Pro, power line communication, etc. The controller may be capable of determining an appropriate lamp current reference or set point based at least in part on the (for example) dimming control signal received from the external device, and adjust the lamp current reference (I_ref) in the driver IC (in step 108). The driver IC may further adjust the frequency of the high and low side gate drive signals, whereby the lamp current is adjusted dynamically during operation.

In various embodiments the controller in step 108 may further determine a filament heating voltage is desired during steady-state lamp operation based at least in part on the control signal from the external device, such as for example where dimming operation is commanded. The controller may be capable of enabling and controlling the filament drive module to provide proper filament heating in a dimming mode through pulse-width modulation (PWM) of the module control signal to the filament drive module (i.e., the Filament_drive_ctl signal in FIGS. 2 and 3). In this manner the optocoupler is not turned on or off throughout a given operation, but is turned on and off by a PWM signal, the duty cycle of which determines the amount of filament heating current to be generated through the lamp filaments.

In step 109, the controller may receive lamp end-of-life (EOL) sensor signals from any one or more lamp drive modules or load circuits, depending on the location of the sensors. As with the overvoltage sensors, EOL sensors are well known in the art and further description of their configuration or location may be omitted herein, as various types of sensors and signals may be used within the scope of the present disclosure.

The controller may determine in step 110 whether an EOL condition is present in lamp module k, where (k=1, 2 . . . x, depending on the number of load circuits). If an EOL condition is sensed, the controller proceeds to step 111 and disables the lamp drive module (k) associated with the overvoltage condition by for example pulling low (i.e., setting to zero) the appropriate module control signal as described above.

After any lamp drive modules have been disabled in step 111 due to an EOL condition, or alternatively where no EOL condition has been detected in step 110, the controller may continue to step 112 wherein the controller may receive signals sensing whether or not a lamp has been replaced, put back, newly installed or otherwise connected to output terminals of a load circuit where previously there had been no filaments detected. If the controller detects in step 113 that a lamp has been so sensed with respect to any lamp drive module k, the controller returns to step 101 and automatically restarts the entire lamp starting sequence.

If the controller instead does not detect in step 113 that a lamp has been replaced, re-installed, newly installed or otherwise recently connected to output terminals of a load circuit, the method returns to step 104 and cycles through steps 104 to 113 until either power is terminated to the ballast, an abnormal condition (overvoltage, EOL, etc.) is detected, or a new or replacement lamp is connected to the ballast.

The previous detailed description has been provided for the purposes of illustration and description. Thus, although there have been described particular embodiments of the present invention of a new and useful "Modular Dimming Ballast with Decoupled Half-Bridge Topology," it is not intended that such references be construed as limitations upon the scope of this invention except as set forth in the following claims.

What is claimed is:

1. An electronic ballast comprising:

an inverter switch driver arranged to provide first drive signals to a shared line branch having a first switch shared among a plurality of decoupled inverter drive modules and to provide second drive signals to a plurality of independent line branches each having a switch and associated with one of the plurality of decoupled inverter drive modules; and a soft switching control circuit coupled to the first switch and configured so as to maintain a soft switching operation of the first switch.

2. The ballast of claim 1, further comprising a ballast controller arranged to provide control inputs for enabling and disabling the switches associated with the plurality of decoupled inverter drive modules.

3. The ballast of claim 2, one or more of the decoupled inverter drive modules coupled to associated load circuits and arranged to provide a voltage across a first set of lamp output terminals associated with the load circuits, and one of the decoupled inverter drive modules further comprising a lamp filament drive circuit arranged to provide a voltage across second and third sets of lamp output terminals associated with the load circuits.

4. The ballast of claim 3, the ballast controller arranged to operate in a first mode wherein control inputs are provided to the switch in the lamp filament drive circuit and generate a filament heating voltage across the second set and across the third set of lamp output terminals associated with the load circuits, and the ballast controller further arranged to operate in a second mode wherein control inputs are provided to the switches in the one or more load circuits and generate a lamp driving voltage across the first set of lamp output terminals associated with the load circuits.

5. The ballast of claim 1, the plurality of decoupled inverter drive modules coupled in parallel with each other between positive and negative DC rails associated with the inverter.

6. The ballast of claim 5, the soft switching control block further comprising an inductive circuit adapted to provide a lag current which turns on a body diode of the first switch prior to conduction of positive current by the first switch.

7. The ballast of claim 6, the first switch further comprising a low side inverter switch, the inductive circuit further comprising a capacitor and an inductor coupled in series with each other and across the source and the drain of the first switch, and a diode coupled between the drain of the first switch and the positive DC rail.

8. The ballast of claim 6, the first switch further comprising a high side inverter switch, the inductive circuit further comprising a capacitor and inductor coupled in series with each other between the source of the first switch and the negative DC rail, and a diode coupled across the series connection of the capacitor and inductor.

9. The ballast of claim 8, the array of decoupled inverter drive modules coupled in parallel between positive and negative DC rails associated with the ballast.

10. The ballast of claim 9, the soft switching control block further comprising an inductive circuit adapted to provide a lag current which turns on a body diode of the first switch prior to conduction of positive current by the first switch.

11. The ballast of claim 10, the first switch coupled to the low side output terminal, the inductive circuit further comprising a capacitor and an inductor coupled in series with each other and across the source and the drain of the first switch, and a diode coupled between the drain of the first switch and a positive DC rail further shared by the array of decoupled inverter drive modules.

12. The ballast of claim 10, the first switch coupled to the high side output terminal, the inductive circuit further comprising a capacitor and inductor coupled in series with each other between the source of the first switch and a negative DC rail further shared by the array of decoupled inverter drive modules, and a diode coupled across the series connection of the capacitor and inductor.

13. An electronic ballast comprising:

an inverter switch driver having a high side switch output terminal and low side switch output terminal;

an array of decoupled inverter drive modules sharing a common first switch arranged to receive driver signals from one of the high side or low side switch output terminals;

each decoupled inverter drive module further comprising a separate second switch arranged to receive driver signals from the other of the high side or low side switch output terminals;

wherein the first switch and the plurality of switches associated with the inverter drive modules further define a plurality of half-bridge inverter modules effective to generate a lamp drive output voltage; and a soft switching control circuit coupled to the first switch and configured so as to maintain a soft switching operation of the first switch.

14. The ballast of claim 13, further comprising a ballast controller arranged to provide control inputs for enabling and disabling the switches associated with each of the decoupled inverter drive modules.

15. The ballast of claim 14, the ballast controller arranged to operate in a first mode wherein control inputs are provided to the switch in the lamp filament drive circuit and generate a filament heating voltage across the second set and across the third set of lamp output terminals associated with the drive circuits, and the ballast controller further arranged to operate in a second mode wherein control inputs are provided to the switches in the one or more load circuits and generate a lamp driving voltage across the first set of lamp output terminals associated with the load circuits.

16. The ballast of claim 13, one or more of the decoupled inverter drive modules coupled to associated load circuits and arranged to provide a drive output voltage across a first set of lamp output terminals associated with the load circuits, and one of the decoupled inverter drive modules further comprising a lamp filament drive circuit arranged to provide a drive output voltage across second and third sets of lamp output terminals associated with the load circuits.

17. A method of operating an electronic ballast, the method comprising:

providing first drive signals to a shared line branch having a first switch shared among a plurality of decoupled inverter drive modules connected in parallel;

providing second drive signals to a plurality of independent line branches each having a switch and associated with one of the plurality of decoupled inverter drive modules, wherein the first switch and the plurality of switches associated with the independent line branches further define a plurality of half-bridge inverter branches effective to generate driver output voltages; and generating a lag current via soft switching control circuitry coupled to the first switch, wherein the lag current turns on a body diode of the first switch prior to conduction of positive current by the first switch so as to maintain a soft switching operation of the first switch.

18. The method of claim 17, one or more of the decoupled inverter drive modules coupled to associated load circuits and arranged to provide a lamp drive output voltage across a first set of lamp output terminals associated with the load circuits, and one of the decoupled inverter drive modules further comprising a lamp filament drive circuit arranged to provide a filament drive output voltage across second and third sets of lamp output terminals associated with the load circuits.

19. The method of claim 18, further comprising the steps of:

providing control inputs in a first operating mode to enable the switch in the lamp filament drive circuit so as to generate the filament drive output voltage across the second set and across the third set of lamp output terminals associated with the drive circuits, and providing control inputs in a second operating mode to enable the switches in the one or more load circuits so as to generate the lamp drive output voltage across the first set of lamp output terminals associated with the load circuits.

20. The method of claim 19, further comprising:

providing control inputs in the first operating mode to disable the switches in the one or more load circuits, and providing control inputs in the second operating mode to disable the switch in the lamp filament drive circuit.

* * * * *